US008499895B2

(12) United States Patent
Zweig

(10) Patent No.: US 8,499,895 B2
(45) Date of Patent: Aug. 6, 2013

(54) SYSTEM AND METHOD FOR PRE-PROGRAMMABLE ELEVATOR OPERATION

(76) Inventor: Zvi Zweig, Ramat HaSharon (IL)

( * ) Notice: Subject to any disclaimer, the term of this patent is extended or adjusted under 35 U.S.C. 154(b) by 301 days.

(21) Appl. No.: 12/915,219

(22) Filed: Oct. 29, 2010

(65) Prior Publication Data

US 2011/0100758 A1 May 5, 2011

(30) Foreign Application Priority Data

Oct. 29, 2009 (IL) ..... 201844

(51) Int. Cl.
*B66B 1/18* (2006.01)

(52) U.S. Cl.
USPC ..... 187/387; 187/247

(58) Field of Classification Search
USPC ..... 187/247, 248, 380–388, 391–393
See application file for complete search history.

(56) References Cited

U.S. PATENT DOCUMENTS 5,159,163 A * 10/1992 Bahjat et al. ..... 187/381
5,808,247 A * 9/1998 Thangavelu ..... 187/386
6,202,799 B1 * 3/2001 Drop ..... 187/388
6,397,976 B1 * 6/2002 Hale et al. ..... 187/392
7,003,654 B2 * 2/2006 Baron ..... 713/1
7,093,693 B1 * 8/2006 Gazdzinski ..... 187/384
7,353,915 B2 * 4/2008 Zaharia et al. ..... 187/388
7,377,364 B2 * 5/2008 Tyni et al. ..... 187/380
7,823,700 B2 * 11/2010 Boss et al. ..... 187/384
8,028,809 B2 * 10/2011 Blackaby et al. ..... 187/391
2003/0034209 A1 * 2/2003 Tang et al. ..... 187/247
2011/0121074 A1 * 5/2011 Makimattila ..... 235/382

* cited by examiner

*Primary Examiner* — Anthony Salata

(74) *Attorney, Agent, or Firm* — Pearl Cohen Zedek Latzer, LLP

(57) ABSTRACT

A system and method for pre-programming operation of an elevator to automatically service particular floors of a building at a designated future interval. A remote user may input instructions over a network to be relayed to an elevator controller including a future interval during which an elevator is to automatically make continuous or periodic trips to and from a particular floor or floors of a building, such that during the designated future interval the elevator automatically and without a user's instructions, reaches the designated floor, opens the door, waits a pre-set time period, closes the door and travels to another floor or floors.

11 Claims, 1 Drawing Sheet

SYSTEM AND METHOD FOR PRE-PROGRAMMABLE ELEVATOR OPERATION

CROSS-REFERENCE TO RELATED APPLICATIONS

This application claims the benefit of Israeli Application No. 201844, Filing Date Oct. 29, 2009, entitled "SYSTEM AND METHOD FOR PRE-PROGRAMMABLE ELEVATOR OPERATION", which is incorporated herein by reference herein.

BACKGROUND OF THE INVENTION

Some individuals may have constraints on their capacity to operate an elevator. For example, Sabbath observers who refrain from operating electric devices on their Sabbath may avoid using an elevator because of the need to operate it by pushing electrical buttons. A typical solution may set the elevator on continuous operation before the Sabbath such that the elevator stops on each or every other floor throughout the Sabbath period. In this way the user may enter the elevator and reach a desired floor without operating the electrical buttons. However, such continuous operation throughout the Sabbath, is expensive and inefficient since for the majority of the Sabbath, the elevator remains unused.

SUMMARY OF THE INVENTION

Embodiments of a system of the invention may include a receiver that is suitable to receive from a network device an instruction for an elevator, where the instruction includes a parameter of automatic operation of the elevator during a future defined period. The system may include a programming interface associated with the network to accept from a remote user one or more of such parameters for the future automatic operation of the elevator and a way to transmit the instruction over the network to a controller of the elevator. In some embodiments, a system for the programming interface may be suitable to accept a floor to be serviced by the elevator during the particular future interval, and the controller may be suitable to direct the elevator to service such floor during the interval on a periodic basis without further input or instructions from a user. The service may include stopping on a given floor(s), opening a door, closing a door and travelling to another floor. In some embodiments, the programming interface may accept a frequency of service by the elevator during the interval.

In some embodiments, the system may include a wireless receiver and a connection to a network that is associated with the wireless receiver. Some embodiments may include a timer to signal the controller upon reaching a start time of the interval and upon reaching an end time of the interval. Some embodiments may include a pricing system that is linked to the timer and the interface.

Some embodiments may include a system having an elevator controller to accept a first future interval during a day for automatic operation of the elevator and a first floor designation for the automatic operation during the first future interval, and to accept a second future interval during the day and a second floor designation for the automatic operation during the second future interval.

Some embodiments of the invention may include a method of storing in a memory an interval for automated operation of an elevator and a floor to be serviced by such automated operation during the interval, activating the automated operation of the elevator for the given floor during that interval, and directing the elevator to service the given floor during the interval at a pre-defined frequency. The automatic service may be later automatically discontinued at the end of the interval.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
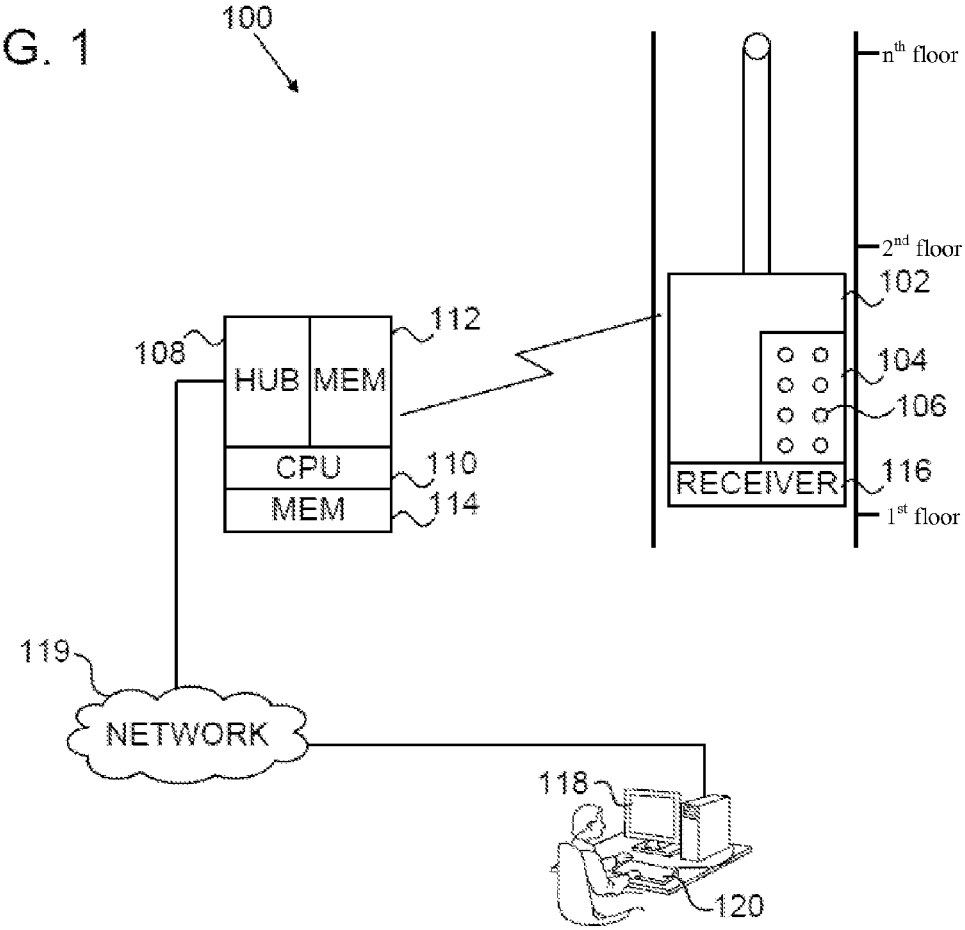
FIG. 1 is a schematic diagram of a programmable automated elevator system in accordance with an embodiment of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

In this paper, the term "automated" or "automatic" may, in addition to their regular meanings, mean the service by an elevator of one or more floors, and the travel by such elevator between such floors without a then-current and manual indication of the floors to be serviced. For example, automated operation may include an elevator reaching a floor of a building without being called by a button on such floor or on another floor, opening its door, waiting with a door opened, closing its door, and travelling to a pre-defined other floor without a button or other indication on the elevator being pushed or activated to indicate such other floor to be reached. Such automated operation may be repeated two or more times, such that without a call button or a button on the elevator being pushed, the elevator may repeatedly travel to and from two or more floors and open its doors on each of such two or more floors in each of such repeated trips.

Reference is made to FIG. 1, a schematic diagram of a programmable automated elevator system in accordance with an embodiment of the invention. System 100 may include one more elevators 102 that may have one or more set of controls 104. Controls 104 may include for example operation buttons 106 as are usually found in an elevator by which a user calls an elevator 102 to a floor, or directs the elevator 102 as to which floor the user wishes to reach. Controls 104 may be linked by wire, wirelessly or otherwise to a central control or hub 108 that may coordinate the movement of one or more of the elevators 102. In some embodiments, hub 108 may also include a wired or wireless connection to allow receipt of commands from a remote location. Hub 108 may include a processor 110 and a memory 112 that may include instructions or algorithms that may centralize the control of one or more elevators 102 to which they are connected. In some embodiments, hub 108 may include a programmable memory 114 that may receive and store instructions, such as a future start time, end time or other future interval for automated operation, and other parameters of such automated operation.

System 100 may include a communication unit such as a wireless or wired communication unit or receiver 116, a programming interface 118 by which a user may access the hub 108 or processor 110 or memory 112 or 114, and in input/output device 120 such as a keyboard, keypad, mouse, screen, telephone, hand-held communication device or other device that may be used for inputting or viewing an instruction, program or setting status of for example hub 108 or elevator 102.

In some embodiments, receiver 116 may be proximate or connected to hub 108 and elevator 102, while device 120 may be remote from hub 108 and elevator 102. Other proximities or locations of hub 108, processor 110, receiver 116 and device 120 are possible. For example, receiver 116 may be proximate to a remote hub 108 or other central control station from which one or more elevators 102 may be operated.

In some embodiments, programming interface 118 may include for example a graphical interface such as a screen of a calendar or time chart and a listing of floor possibilities. A user may designate one or more start or end times on a particular date to show a start and end time for the automated operation of the elevator, and may show one or more floors to be serviced by such automated operation during the designated interval.

In operation, a user may use device 120 to access programming interface 118 in advance of the Sabbath or other holiday where observers refrain from taking actions that activate electrical mechanisms, such as the day before the Sabbath, and may direct hub 108 to operate elevator 102 during specific times during the Sabbath. For example, a user may know that between 7:30 AM and 8:30 AM and between 10:30 AM and 11:30 AM on the Sabbath the user will want to go from the $8^{th}$ floor of a building to the ground floor of the building or back from the ground floor of the building to the $8^{th}$ floor. In advance of the Sabbath, a user may input into the programming interface 118 that he wants the elevator to make numerous trips from the $8^{th}$ floor to the ground floor between those periods. The programming interface 118 may connect with for example receiver 116, and a timer component of hub 108 on elevator 102 to make continuous or periodic trips between the $8^{th}$ floor and the ground floor during those designated times. When the designated time is over, the continuous trips may end, and the elevator 102 may resume its regular functions or may go to 'out of service' or assume some other mode of operation.

In some embodiments, other users on other floors may likewise know in advance of the Sabbath that they will want to go between other floors and the ground floor or among other floors at given intervals during the Sabbath. Such other users may likewise enter their desired floors and the intervals during the Sabbath that they want to initiate continuous trips of the elevator. Hub 108 may coordinate trips during such period to match the input of the various users. For overlapping periods of continuous trips that may be inputted by several users, hub 108 may adapt the continuous trips to stop on some or all of the desired floors on each trip during the overlapping periods. For each such stop, elevator 102 may stop and open the door on the given floor and wait a pre-set time before closing and continuing the trip.

In some embodiments, programming interface 118 may be implemented over, associated with or connected to for example a network 119 such as a local area or wide area network, a telephone or cellular network or the Internet, where one or more users of an elevator 102 or for example residents of or visitors to a building may access for example a calendar for inserting instructions for the operation of an elevator 102 in their own building, such that the remote user may mark a particular interval on the calendar and a floor or floors that are to be subject to continuous service during that interval. Other parameters for automated operation that may be input into the calendar or programming interface may include for example, frequency or periodicity of the service of the one or more pre-designated floors, whether the service between one or more floors is to stop at other floors, the duration of time that the doors are to stay open on one or more floors, etc.

In some embodiments, programming interface 118 may be connected to or associated with a network device that may transmit instructions for the automated operation of elevator 102 to hub 108 by way of receiver 116.

In some embodiments, a user may input a frequency of trips to be made by the elevator during the designated interval. For example, a user may indicate that during the designated interval, the elevator is to make one trip every two minutes to and from the relevant floor. Alternately, to save money or power, the user may direct that the elevator is to make one trip every five minutes during the relevant interval. Other variable or selectable frequencies of trips by the elevator may be used. For example, a program may direct that the elevator is to make regular trips at least every 10 minutes during the Sabbath. Such frequency may be increased during the morning hours to every 5 minutes, and then decreased again to every 8 minutes during the afternoon hours. Other periodicities or frequencies may be used.

In some embodiments, a pricing system may be associated with the programming interface so that a user is charged for the period during which he programs the elevator for continuous use. In some embodiments, memory 112 may record a number of trips made by the elevator during the designated interval, and a charge may be computed based on such number of trips.

In some embodiments, the system may include option overrides for emergency services, for a manager who may want to limit or take control of the programming or operation of the elevator in a particular period, or for residents or users to resolve clashes or differing instructions that are entered into the system relating to a particular period. In some embodiments, a program or operating system may include a means of optimizing the service of an elevator for an interval when two or more instructions are applicable. For example, if a first user wants the elevator to go between floor 1 and floor 8 between 8 AM and 9 AM, and a second user wants to the elevator to go between floor 4 and floor 1 at that same time, the system may stop at both floor 8 and floor 4 for all or some trips during that period. In some embodiments the system may be linked to a calendar so that regular or fixed schedules of trips can be input for all Sabbaths and holidays, so that users will not have to program the system for each Sabbath. Similarly, the system can be linked to a solar calendar so that start times and end times of the Sabbath can be linked to the start time and end time of the operation of the system.

Figure 2:
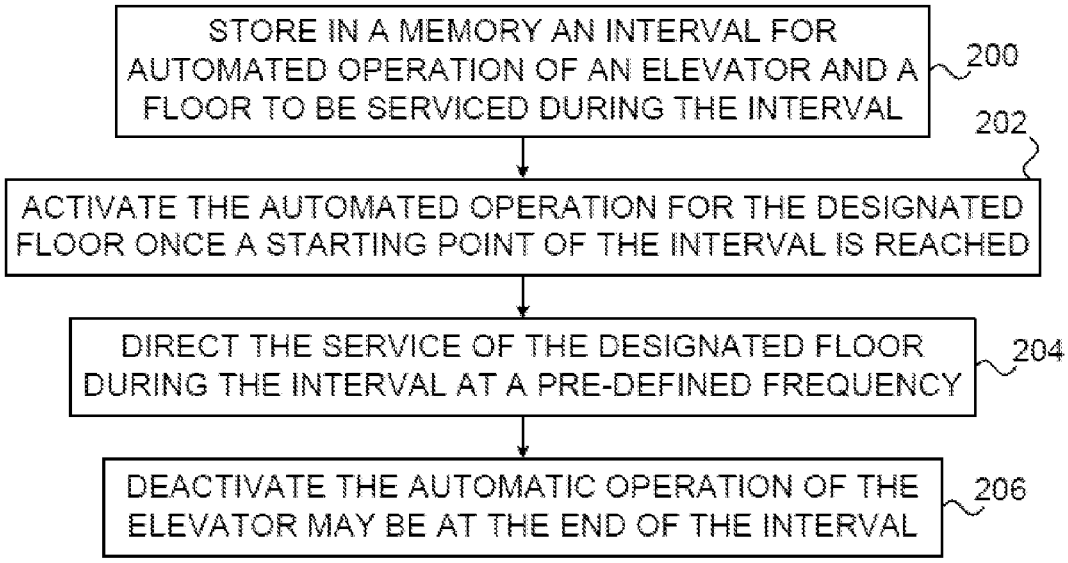
FIG. 2 is a flow diagram of a method in accordance with an embodiment of the invention.

Reference is made to FIG. 2, a flow chart of a method in accordance with embodiments of the invention. In block 200, a user may store in a memory an interval for automated operation of an elevator and a floor to be serviced by such automated operation during the interval. In block 202 the automated operation of the elevator for the designated floor may be activated once a starting point of the interval is reached. In block 204, the elevator may be directed to service the designated floor during the interval at a pre-defined frequency. In block 206, the automatic operation of the elevator may be deactivated at the end of the interval.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A system comprising:

a receiver suitable to receive from a network device an instruction for an elevator, said instruction comprising a parameter of a future intervals of automatic operation of said elevator;

a controller suitable to receive from said receiver said instructions and to control said automatic operation of said elevator;

a programming interface associated with said network to accept from a remote user said parameter for said future intervals of automatic operation of said elevator and to transmit said instruction over said network;

wherein said programming interface is suitable to accept a floor to be serviced by said elevator during said interval, and to accept a frequency of service by said elevator during said interval; and wherein said controller is suitable to direct said elevator to service said floor during said interval at a periodic basis at said frequency.

2. The system as in claim 1, wherein said programming interface is suitable to accept a plurality of floors to be serviced during said interval, and wherein said controller is suitable to direct an operation of said elevator to service said floor during said interval.

3. The system as in claim 1, wherein said receiver comprises a wireless receiver, and wherein said programming interface is suitable for connection to a network that is associated with said wireless receiver.

4. The system as in claim 1, comprising a timer suitable to signal said controller upon reaching a start time of said interval and upon reaching and end time of said interval.

5. The system as in claim 1, wherein said programming interface includes a pricing system to assign a charge for programming of an operation of said elevator during said interval.

6. The system according to claim 1 wherein said controller is suitable to accept a first future interval during a day for automatic operation of said elevator and a first floor designation for said automatic operation during said first future interval, and a second future interval during said day and a second floor designation for said automatic operation during said second future interval.

7. The system as in claim 6, wherein said controller comprises a wireless receiver suitable for connection to a network.

8. The system as in claim 6, wherein said controller is suitable to record a frequency of said automatic operation of said elevator during said first interval and said second interval to direct said elevator to service said floor during said interval at a periodic basis at said frequency.

9. A method comprising:

storing in a memory an interval for automated operation of an elevator and a floor to be serviced by such automated operation during said interval;

activating said automated operation of said elevator for said floor during said interval;

directing said elevator to service said floor during said interval at a pre-defined frequency; and deactivating said automated operation at the end of said interval.

10. The method as in claim 9, comprising inputting said interval from a remote device, said remote device linked to said memory over a network.

11. The method as in claim 9, comprising calculating a charge for said automated operation of said elevator during said interval based on said frequency.

* * * * *